US006195819B1

(12) United States Patent
Wang

(10) Patent No.: US 6,195,819 B1
(45) Date of Patent: Mar. 6, 2001

(54) TOUCH POP-UP STOPPER FOR BASIN DRAIN

(76) Inventor: Ching-Piao Wang, No. 9, Lane 67, Hu Shan Road, Yingko Town, Taipei Hsien (TW)

( * ) Notice: Subject to any disclaimer, the term of this patent is extended or adjusted under 35 U.S.C. 154(b) by 0 days.

(21) Appl. No.: 09/475,975

(22) Filed: Dec. 30, 1999

(51) Int. Cl.[7] ..... E03C 1/23
(52) U.S. Cl. ..... 4/689; 4/287; 4/295
(58) Field of Search ..... 4/287, 295, 684, 4/689; 201/263

(56) References Cited

U.S. PATENT DOCUMENTS 3,220,695 * 11/1965 Downey et al. ..... 4/295 X
3,333,815 * 8/1967 Downey et al. ..... 4/295 X
3,428,295 * 2/1969 Downey et al. ..... 4/295 X
4,860,390 * 8/1989 Ohta ..... 4/295

* cited by examiner

*Primary Examiner*—Robert M. Fetsuga
(74) *Attorney, Agent, or Firm*—Rosenberg, Klein & Lee

(57) ABSTRACT

The present invention relates to a touch pop-up stopper for basin drain which comprises a stopper assembly for draining (ON) or stopping (OFF) water which is fitted to the inside of a drain flange, wherein the stopper assembly includes a casing, a lift body, a turning body, a spring, a bottom casing, a cap and a sealing ring, and wherein an engaging member is created by means of the structure of longitudinal notches at the inner rim of the casing and disposed between a first slide way and a second slide way, and wherein the outer rim of the lift body is provided with protruding pieces corresponding to the longitudinal notches, and wherein a plurality of slide pieces fitted with a slant end at the top thereof and corresponding to protruding pieces are provided at the outer rim of the turning body; by means of the sliding and shifting movement of the three above-mentioned components and through an upward resilient force of the spring, the user only requires to give a slight force to the cap at the top of the lift body to achieve the draining or stopping effect; easy to assemble, convenient to use; moreover, the casing of the present invention has a filter screen at the top thereof so that the hair and miscellaneous objects won't be led into the drain.

1 Claim, 7 Drawing Sheets

TOUCH POP-UP STOPPER FOR BASIN DRAIN

BACKGROUND OF THE INVENTION (a) Field of the Invention

The present invention relates to a touch pop-up stopper for basin drain, and more particularly, to a stopper easy to install, convenient to use and which can prevent miscellaneous objects from being led into the drain.

(b) Description of the Prior Art

A conventional touch pop-up stopper for basin drain, as shown in FIG. 1, has a drain flange (A) fitted to a drain opening at the bottom of the basin (H). The drain flange (A) includes a stopper (B) therein and is connected to a union-T (C) at the bottom thereof. The union-T (C) is laterally provided with an operating rod (D) having seesaw effect while a longitudinal lift rod (E) is pivoted at the outer end of the operating rod (D). The top of the longitudinal lift rod (E) protrudes over the faucet (G) in order for the user to pull the operating rod (D) up so that the stopper (B) descends to be in a closed (OFF) state or to push the operating rod (D) down so that the stopper (B) ascends to be in a draining (ON) state. However, the pop-up stopper of the prior art has disadvantages as follows:

1. Difficult to install: The gap between the faucet (G) and the wall (F) has to be controlled precisely; otherwise, the hand will touch the wall (F) in operating the longitudinal lift rod (E). Moreover, the lift rod hole (g) of the faucet (G) must be inclined correctly; otherwise, the longitudinal lift rod (E) can't be installed.
2. Numerous components: The whole assembly includes not only the drain flange (A) and the stopper (B), but also the union-T (C), the operating rod (D) and the longitudinal lift rod (E). The assembly is not only time-wasted and force-wasted, but also it's inconvenience for packing and storage so that it doesn't meet the economic efficiency. In addition, the longitudinal lift rod (E) has to be pulled upwards or pushed downwards so that the defect frequently appears.
3. Increase of defects: The longitudinal lift rod (E) is a necessary component so that a lift rod hole (g) must be reserved in molding the faucet (G). However, it will easily create sand holes inside so that the defective molding is relatively increased, and it's annoying for experts in this industry.
4. Safety: The longitudinal lift rod (E) is fitted to the side of the faucet (G) near the wall so that the small children have to grasp the basin (H) for climbing up to operate the longitudinal lift rod (E) for draining water in the basin. However, it is very dangerous because the children might fall down to the ground and are therefore injured.
5. Easy to be blocked: No filter screen is provided between the stopper (B) and the drain flange (A) so that the miscellaneous objects like garbage, hair are easily led into the sink drain (I) and cause blockade.

SUMMARY OF THE INVENTION

It is a primary object of the present invention to provide a touch pop-up stopper for basin drain which is easy to install and practical to use.

It is another object of the present invention to provide a touch pop-up stopper for basin drain which simplifies components and is convenient for carrying and packing.

It is a further object of the present invention to provide a touch pop-up stopper for basin drain which has a filter screen to prevent miscellaneous objects to be led into the drain in order to ensure its smooth draining.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
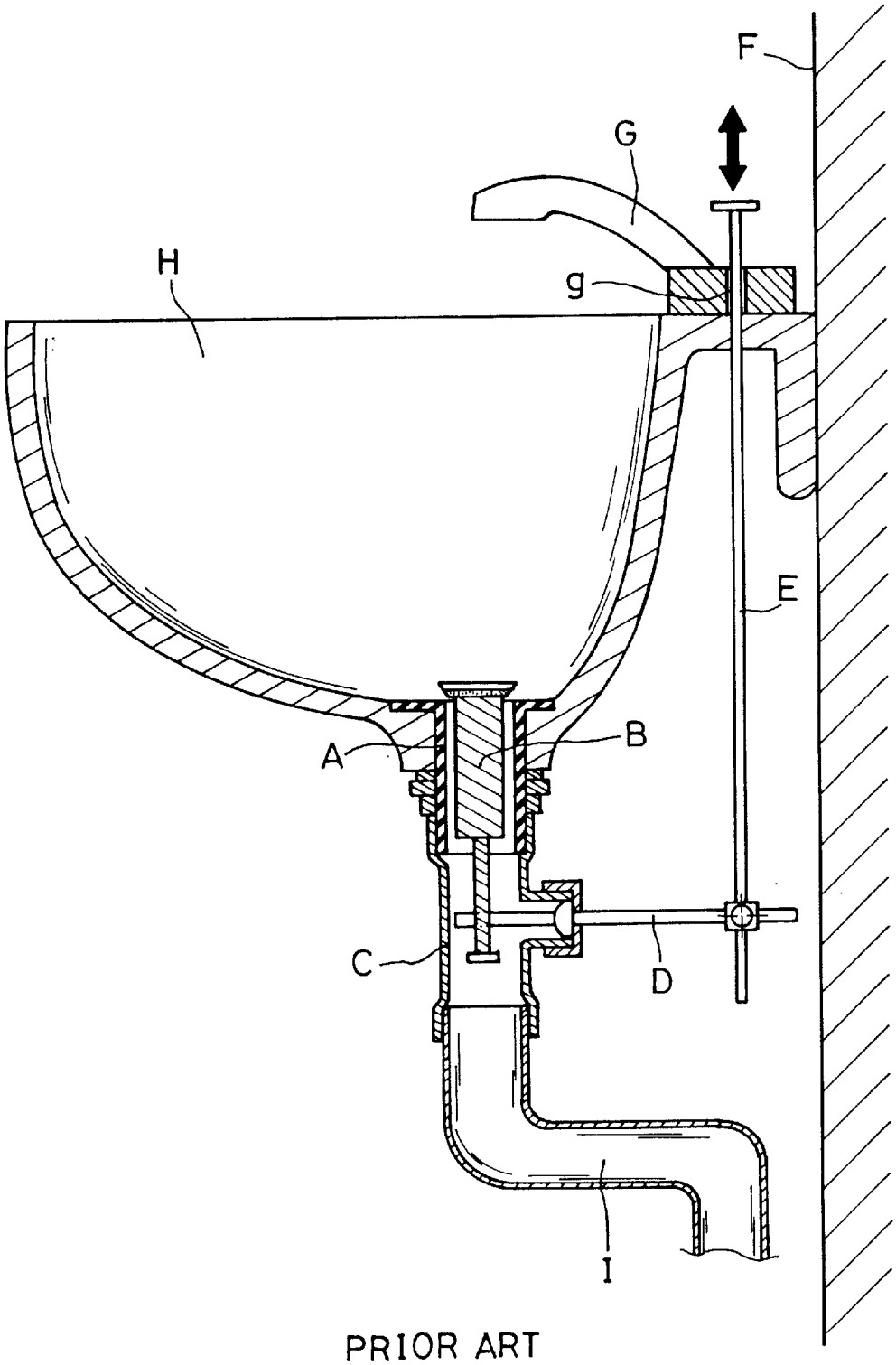
PRIOR ART FIG. 1
FIG. 1 is a schematic drawing of a conventional touch pop-up stopper for basin drain.
Figure 2:
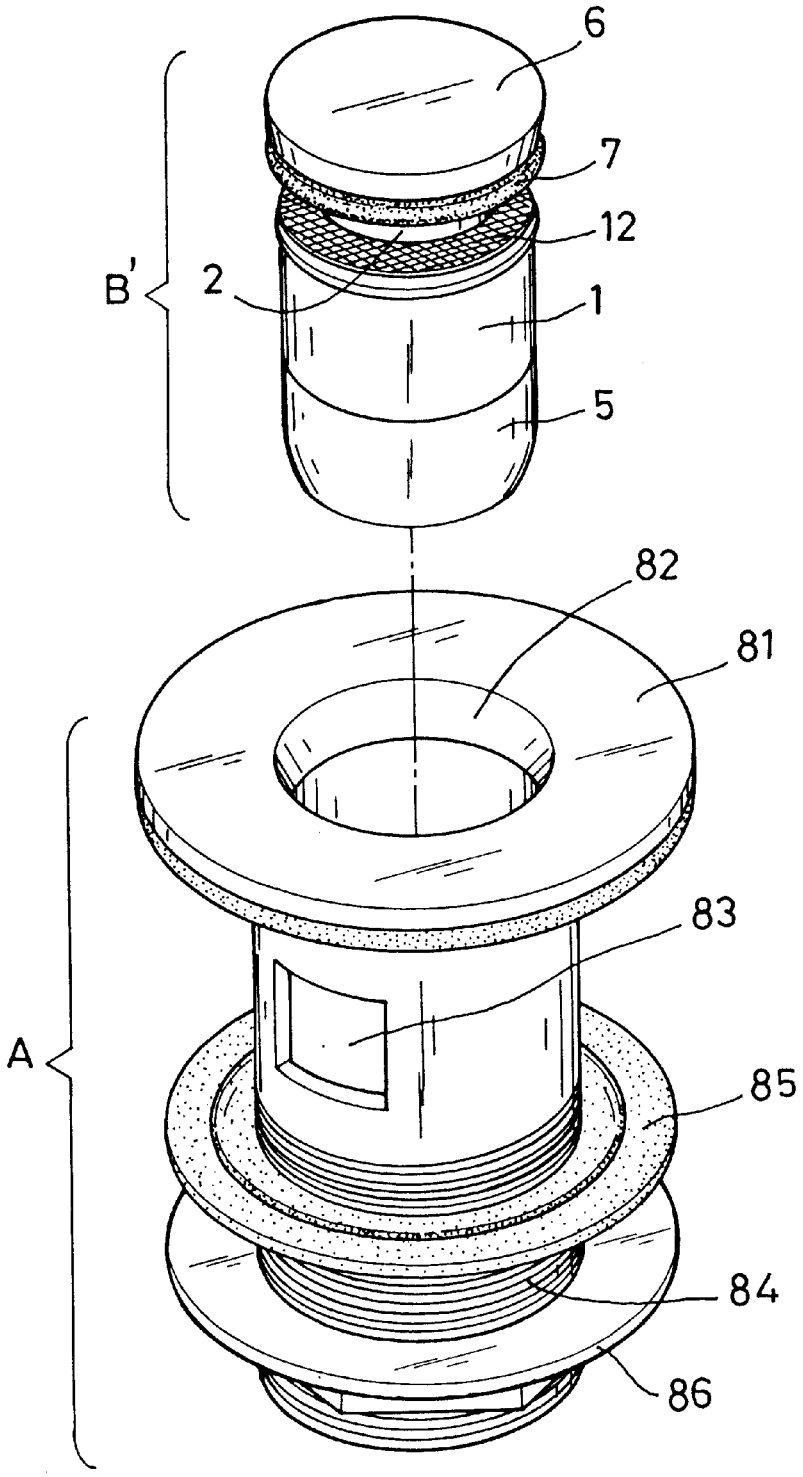
FIG. 2 is a perspective exploded view of a preferred embodiment of the present invention.
Figure 3:
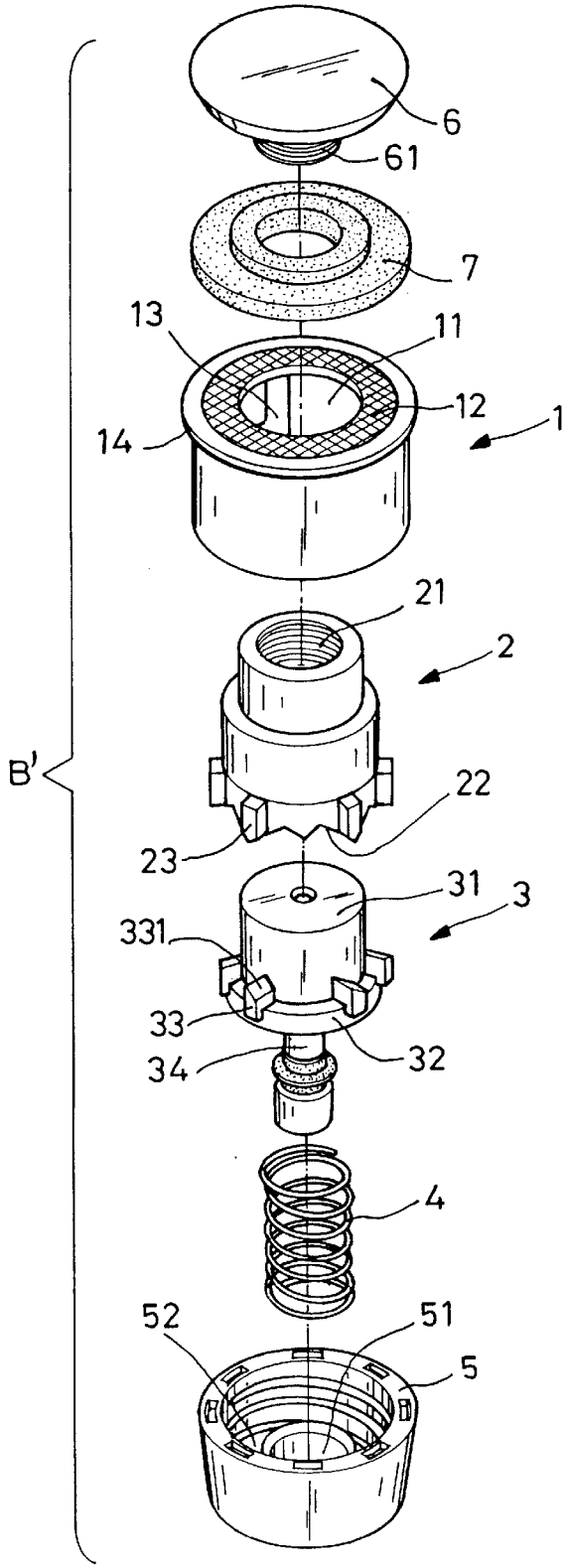
FIG. 3 is a perspective exploded view of a stopper assembly of the present invention.
Figure 4:
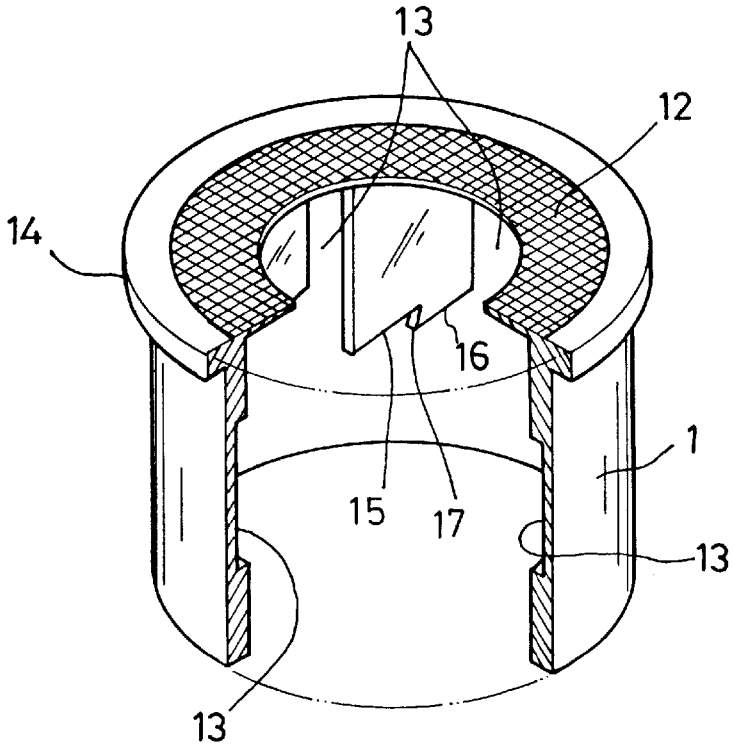
FIG. 4 is a perspective structural view of a casing of the stopper assembly of the present invention.
Figure 5:
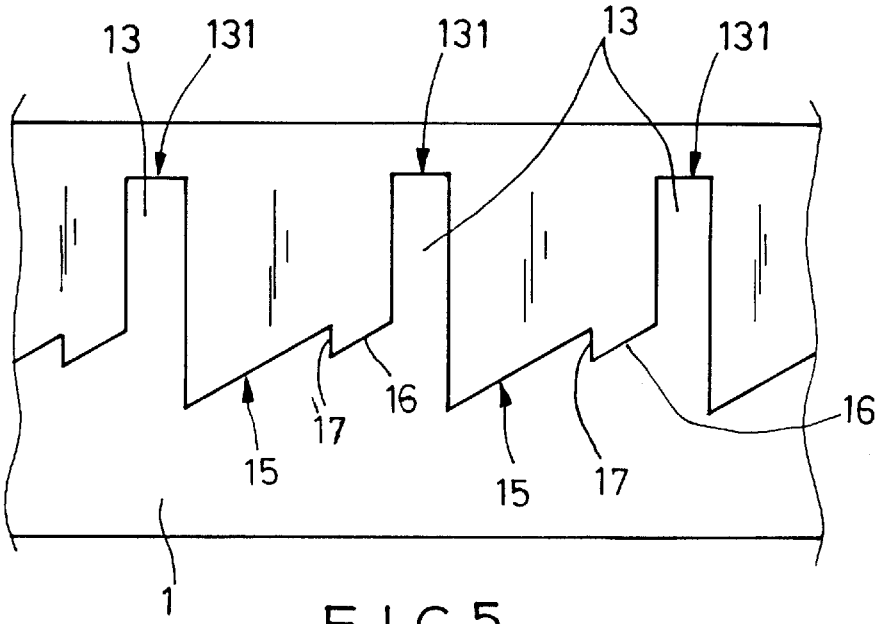
FIG. 5 is a developed view of the inside of the casing of FIG. 4.

First of all, referring to FIGS. 2 and 3, an applicable embodiment of the present invention includes:

a conventional drain flange (A) having a locating flange body 81 at the top rim thereof and with a conic drain opening 82 at the center thereof, and a vent hole 83 is disposed at the middle portion thereof, and the bottom end thereof is provided with a male thread 84 for connecting a plastic washer 85 and a nut 86; and a stopper assembly (B') mounted in the drain opening 82 of said drain flange (A) in order to control the draining (ON) or stopping (OFF) state of the drain flange (A); characterized in that the stopper assembly (B') primarily comprises:

a casing 1 made in accordance with the diameter of the drain opening 82 of the drain flange (A) in order to be located at a pre-arranged position inside of the drain opening 82, having a through hole 11 at the top center thereof which is provided with a filter screen 12 at the rim thereof and having a plurality of equidistant longitudinal notches 13 which have a closed end 131 at the top thereof while the bottom thereof is open, as shown in FIG. 4 and 5, wherein a first slide way 15 and a second slide way 16 are slantly provided between every two notches 13 while an engaging member 17 is created between the first slide way 15 and the second slide way 16;

a lift body 2 provided in the casing 1 and having a screw hole 21 at the top of the inner side which protrudes over the through hole 11 of the casing 1, and the bottom thereof has a cavity and a plurality of saw teeth 22 are created on the end surface thereof, and the outer rim of the saw teeth 22 is provided with protruding pieces 23 corresponding to the longitudinal notches 13 at the inner side of the casing 1 so that the lift body 2 can be shifted upwards and downwards in the casing 1, and the protruding pieces 23 have a sharp-conic member 231 at the bottom thereof;

a turning body 3, a top member 31 of which can be placed into the cavity at the bottom of the lift body 2 while a flange 32 is created at the bottom end thereof, and a plurality of slide pieces 33 corresponding to protruding pieces 23 are provided on the flange 32, and each slide piece 33 has a slant top end 331, and the inner side of the turning body 3 is extended downwards with a locating rod 34;

a spring 4 fitted to the locating rod 34 to force the turning body 3 to have an upward supporting force;

a bottom casing 5 connected to the bottom end of the casing 1 and having a protruding locating hole 51 at the center of the bottom end thereof in order that the bottom end of the locating rod 34 of the turning body 3 is inserted for locating, and an outlet 52 is provided at the rim of the locating hole 51;

a cap 6 created in accordance with the diameter of an outlet 82, and a screw 61 is mounted on the bottom end thereof and can be screwed in the screw hole 21; and a sealing ring 7 disposed at the bottom end of the cap 6 to press into the outlet 82 in order to achieve the sealing effect.

Figure 6:
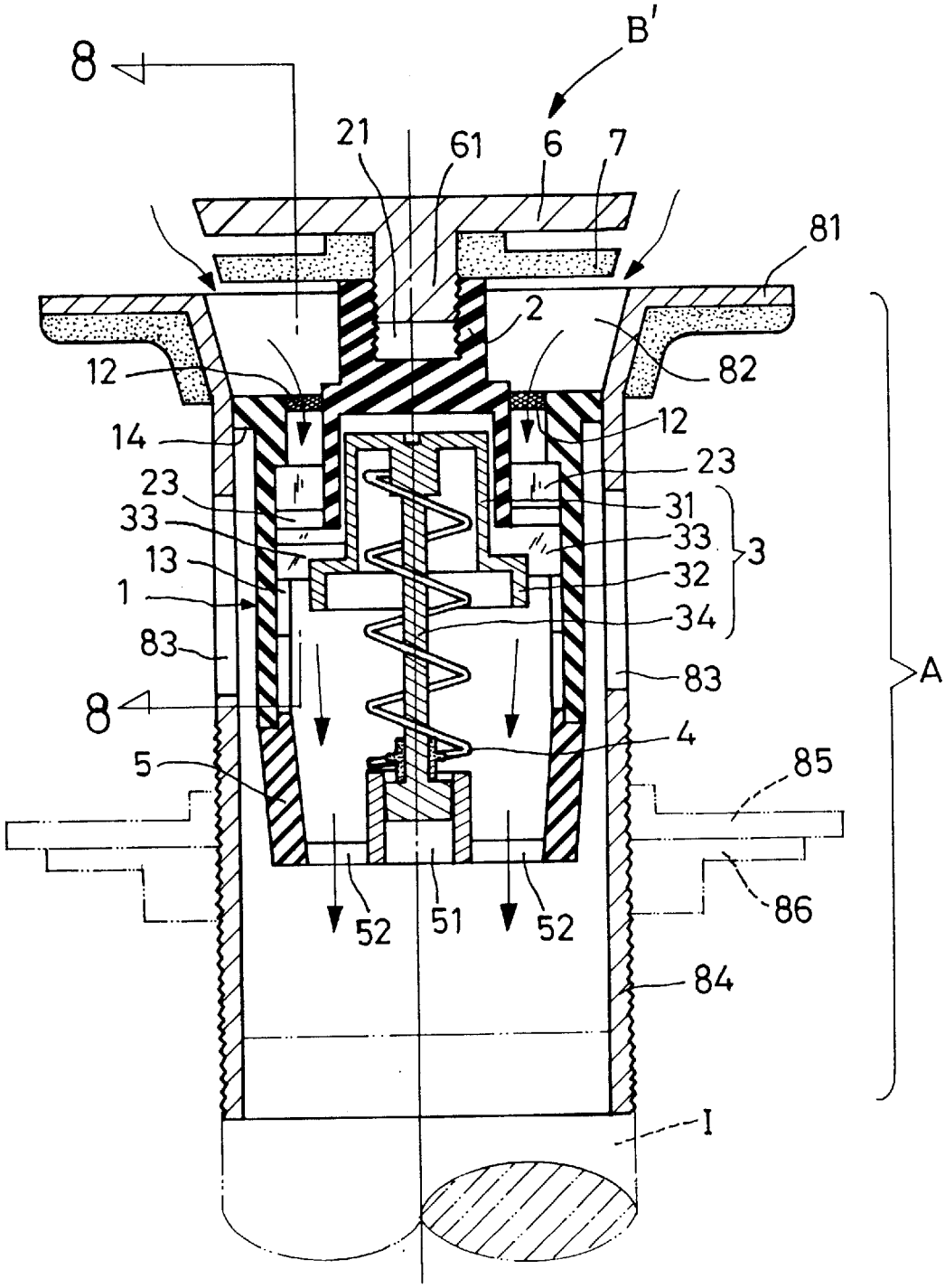
FIG. 6 is a cutaway view of the preferred embodiment, illustrating the stopper assembly in a draining (ON) state.
Figure 7:
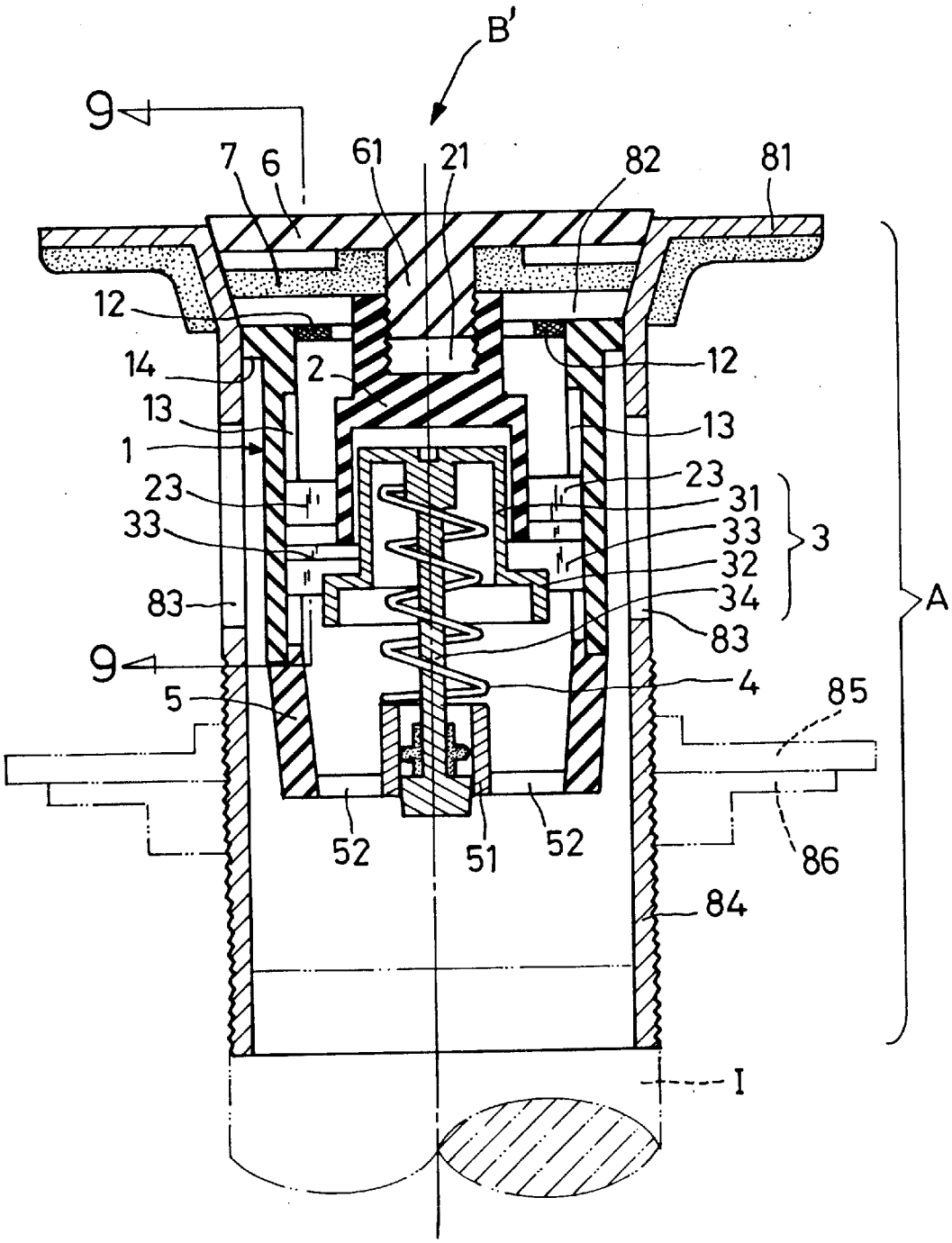
FIG. 7 is a cutaway view of the preferred embodiment, illustrating the stopper assembly in a stopping (OFF) state.
Figure 8:
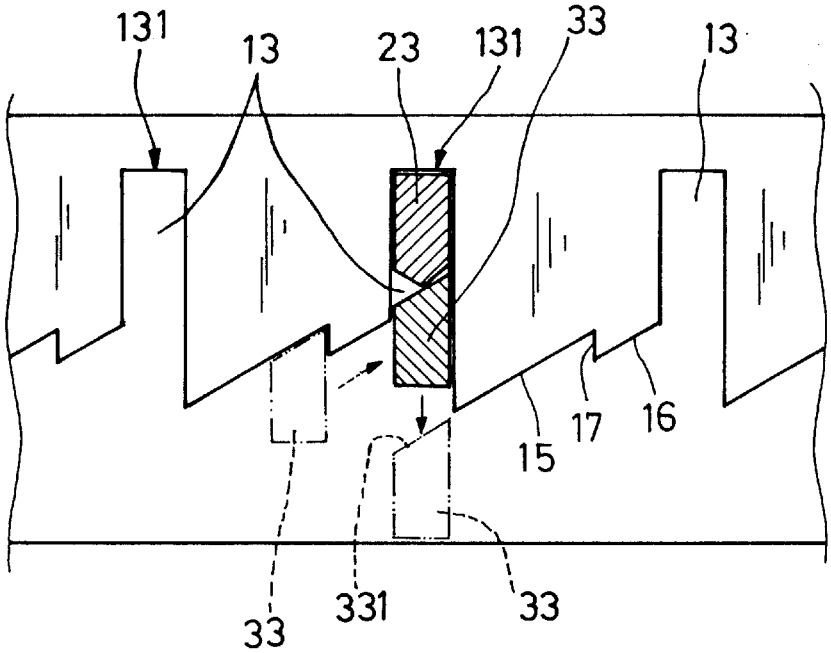
FIG. 8 is a partially cutaway view taken along the line 8—8 of FIG. 6.

FIGS. 6 and 7 show the present invention after assembly, wherein FIG. 6 illustrates a draining state (ON) while FIG. 7 a stopping state (OFF). The way of activation and use thereof are shown as follows:

After assembly, it's only required to place the stopper assembly (B') of the present invention into the outlet 82 of the drain flange (A) to a pre-arranged position. At that time, the casing 1 is located inside of the outlet 82 by means of an outer rim 14 thereof and it won't slide downwards. The spring 4 is situated in a compressed state after the bottom casing 5 is connected to the bottom end of the casing 1; thereafter, an upward supporting force upon the turning body 3 is created so that the slide pieces 33 at the rim of the turning body 3 will shift the protruding pieces 23 of the lift body 2 upwards to the closed end 131 at the top of the longitudinal notches 13, as shown in FIG. 8. Therefore, the lift body 2 is so lifted that the cap 6 and the sealing ring 7 are separated from the outlet 82, and the water in the basin (H) will be smoothly drained through the outlet 82, the filter screen 12 and the outlet 52 to the sink drain (I).

Figure 9:
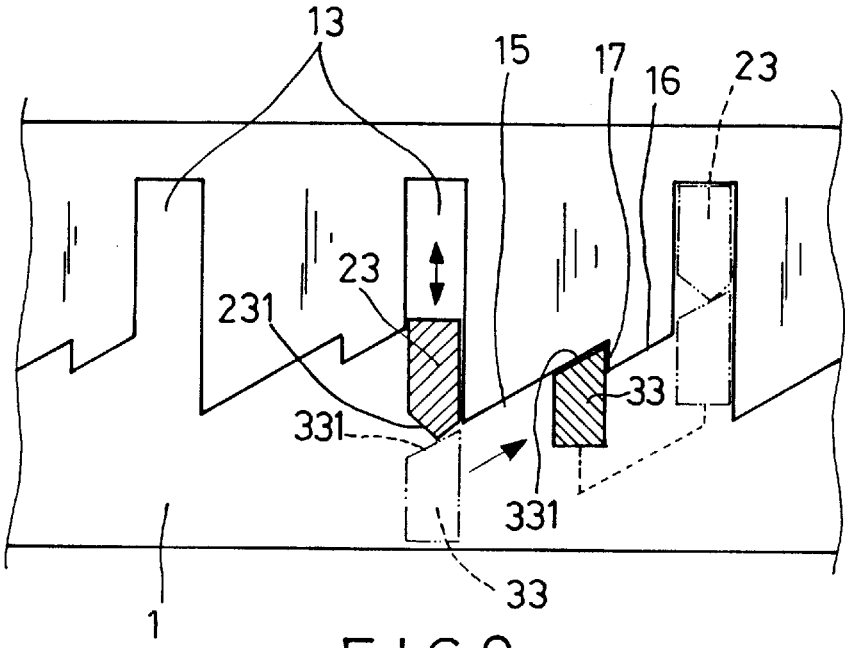
FIG. 9 is a partially cutaway view taken along the line 9—9 of FIG. 7.

In order to store water in the basin (H), it's only required to use fingers to press the cap 6 down, and it will be inserted together with the sealing ring 7 into the outlet 82. As shown in FIG. 7 and 9, when the cap 6 is pressed down, the lift body 2 will be shifted downwards. Also, the protruding pieces 23 at the outer rim of the lift body 2 will be shifted downwards along the longitudinal notches 13 at the inner rim of the casing 1 to push the slide pieces 33 of the turning body 3 downwards, and the turning body 3 is also shifted downwards. When the slide pieces 33 descend until separated from the longitudinal notches 13, the slide pieces 33 will slide along the slant top end 331 to the first slide way 15 and is located at the position of the engaging member 17 because the top of the slide pieces 33 have a slant top end 331 corresponding to the incline of the first slide way 15 and the protruding pieces 23 have a sharp-conic member 231 at the bottom thereof. At that time, the turning body 3 has been turned at a little angle.

Accordingly, each time when the user presses the cap 6 down, the turning body 3 with slide pieces 33 at the rim thereof will descend first; thereafter, the turning body 3 will be turned at an angle by means of the slant top end 331 of the slide pieces 33 and is fixed on the engaging member 17. At that time, the turning body 3 give no upward supporting force to the lift body 2 at the top thereof so that the cap 6 and the sealing ring 7 are located in the outlet 82 to create a stopping (OFF) state.

Furthermore, when the cap 6 is slightly pressed again, the turning body 3 will be forced by the lift body 2 downwards at a small height while the slide piece 33 is separated from the engaging member 17; thereafter, the slide piece 33 slides along the second slide way 16. When a next longitudinal notch 13 is reached, the protruding piece 23 of the lift body 2 will be rapidly pushed upwards by means of the resilient force of the spring 4 at the bottom of the turning body 3; therefore, the lift body 2 ascends so that the cap 6 and the sealing ring 7 are separated from the outlet 82 and recover in a draining (ON) state, as shown in FIG. 6.

By means of the above-mentioned structure, the touch pop-up stopper for basin drain in accordance with the present invention doesn't require the components like the union-T (C), the lateral stop rod (D) and the longitudinal lift rod (E). Therefore, the assembly is very easy and can be rapidly completed; it's only required to screw the drain flange (A) with the nut 86 to the bottom edge of the basin (H). Moreover, the faucet (G) doesn't require the lift rod hole (g) so that the defects can be reduced. In addition, all control components are assembled in the stopper assembly (B') so that the present invention is small and light, and easy to use. The water can be stopped or drained only by pressing with a slight force, even practical for the children. At last, the casing 1 of the present invention has a filter screen 12 at the top thereof so that the hair and miscellaneous objects won't be led into the drain, and a smooth draining can be achieved.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claim.

What is claimed is:

1. A touch pop-up stopper for basin drain comprising:

a drain flange having a locating flange body at the top rim thereof and with a conic drain opening at the center thereof, and a vent hole is disposed at the middle portion thereof, and the bottom end thereof is provided with a male thread for connecting a plastic washer and a nut; and a stopper assembly mounted in said drain opening of said drain flange in order to control the draining (ON) or stopping (OFF) state of the drain flange; characterized in that the stopper assembly primarily comprises:

a casing made in accordance with the diameter of said drain opening of said drain flange in order to be located at a pre-arranged position in said drain opening, having a through hole at the top center thereof which is provided with a filter screen at the rim thereof and having a plurality of equidistant longitudinal notches which have a closed end at the top thereof while the bottom thereof is open, wherein a first slide way and a second slide way are slantly provided between every two notches while an engaging member is created between said first slide way and said second slide way;

a lift body provided in said casing and having a screw hole at the top of the inner side which protrudes over said through hole of said casing, and the bottom thereof has a cavity and a plurality of saw teeth are created on the end surface thereof, and the outer rim of said saw teeth is provided with protruding pieces corresponding to said longitudinal notches at the inner side of said casing so that said lift body can be shifted upwards and downwards in said casing, and said protruding pieces have a sharp-conic member at the bottom thereof;

a turning body, a top member of which can be placed into said cavity at the bottom of said lift body while a flange is created at the bottom end thereof, and a plurality of slide pieces corresponding to protruding pieces are provided on said flange, and each slide piece has a slant top end, and the inner side of said turning body is extended downwards with a locating rod;

a spring fitted to said locating rod to force said turning body to have an upward supporting force;

a bottom casing connected to the bottom end of said casing and having a protruding locating hole at the center of the bottom end thereof in order that the bottom end of said locating rod of said turning body is inserted for locating, and an outlet is provided at the rim of said locating hole;

a cap created in accordance with the diameter of said drain opening, and a screw is mounted on the bottom end thereof and can be screwed in said screw hole; and a sealing ring disposed at the bottom end of said cap to press into said drain opening in order to achieve the sealing effect.

* * * * *